United States Patent [19]

Beney

[11] Patent Number: 4,768,241

[45] Date of Patent: Sep. 6, 1988

[54] SELF CONTAINED, MOBILE INTENSIVE CARE BED STRUCTURE

[76] Inventor: Daniel R. Beney, 44074 Proctor, Canton, Mich. 48188

[21] Appl. No.: 17,993

[22] Filed: Feb. 24, 1987

[51] Int. Cl.[4] ..... A61G 7/00

[52] U.S. Cl. ..... 5/60; 5/503; 5/507

[58] Field of Search ..... 5/60–66, 5/503, 507, 508, 310, 308, 286; 269/322, 323

[56] References Cited

U.S. PATENT DOCUMENTS

| | | | |
|---|---|---|---|
| 3,024,474 | 3/1962 | De Bella . | |
| 3,277,887 | 10/1966 | Thomas . | |
| 3,338,323 | 8/1967 | Swersey . | |
| 3,514,794 | 6/1970 | Pofferi | 5/2 R |
| 3,694,830 | 10/1972 | Koller . | |
| 3,722,611 | 3/1973 | Tirkkonen . | |
| 3,761,968 | 10/1973 | Besler . | |
| 3,808,613 | 5/1974 | Carpentier et al. | 5/63 |
| 3,840,924 | 10/1974 | Hamilton . | |
| 4,016,612 | 4/1977 | Barile, Sr. . | |
| 4,033,420 | 4/1977 | De Masters . | |
| 4,281,730 | 8/1981 | Swersey et al. . | |
| 4,308,642 | 1/1982 | Heyman . | |
| 4,352,991 | 10/1982 | Kaufman | 5/503 X |
| 4,431,154 | 2/1984 | Hamm . | |
| 4,489,449 | 12/1984 | Failor et al. | 5/63 X |
| 4,489,454 | 12/1984 | Thompson . | |
| 4,506,872 | 4/1985 | Westerberg et al. . | |
| 4,534,077 | 8/1985 | Martin . | |
| 4,584,989 | 4/1986 | Stith | 5/503 X |
| 4,691,397 | 9/1987 | Netzer | 5/507 |

*Primary Examiner*—Michael F. Trettel

*Attorney, Agent, or Firm*—Harness, Dickey & Pierce

[57] ABSTRACT

A self contained, mobile intensive care bed structure adapted to carry a plurality of devices for monitoring and/or providing treatment to a patient in the bed structure and including built in direct current lines and outlets, communication lines and outlets, a pneumatic oxygen air and vacuum lines and outlets, and a direct current source, with the bed structure being operable in a stationary mode from fixed sources of d-c power, a-c power, oxygen, air and/or vacuum.

31 Claims, 2 Drawing Sheets

Fig-1
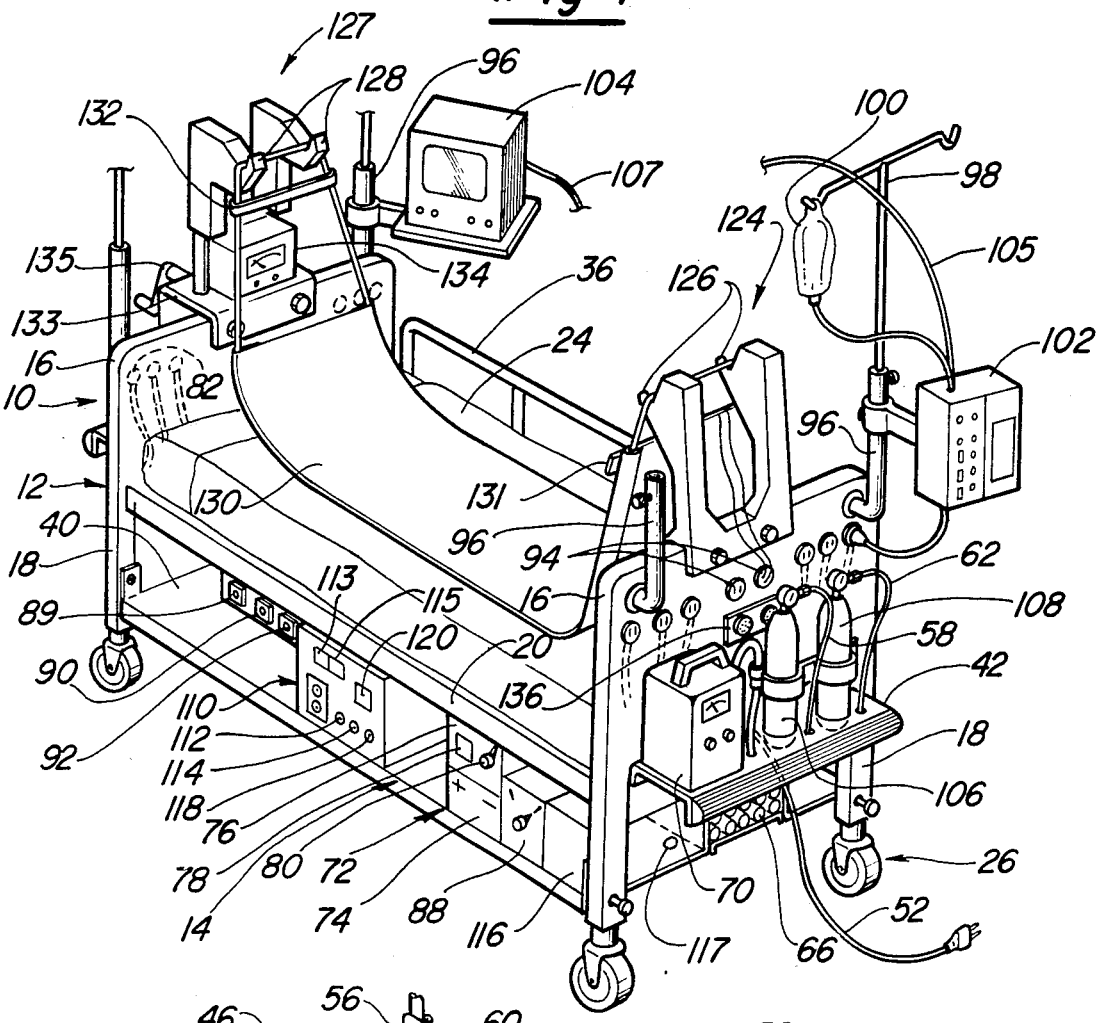
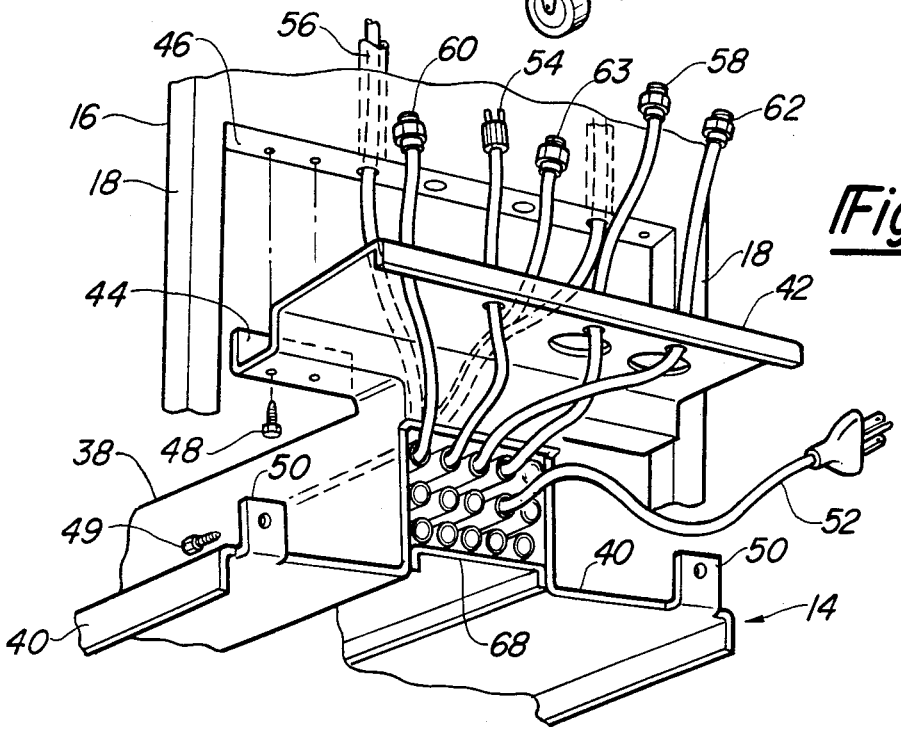
Fig-2

SELF CONTAINED, MOBILE INTENSIVE CARE BED STRUCTURE

SUMMARY BACKGROUND OF THE INVENTION

The present invention relates to apparatus for providing intensive care to hospital patients and more particularly to a bed structure in the form of a self-contained, mobile intensive care unit.

In providing intensive care to hospital patients, quite frequently the bed patient will be surrounded by numerous devices not only for administering medication, oxygen and the like but also for monitoring the condition of the patient. The problem with such an arrangement is that quick and open access to the patient can be obstructed by the various devices positioned about the bed. Also the random location of the devices inhibits the rapid utilization of devices during critical time periods. In addition, most of the devices are separate from the bed and hence, even if the bed is movable, movement of the patient and bed is inhibited and movement in the event of an emergency would require that most of the devices be disconnected and left behind.

In the present invention a bed structure is provided which has support means to hold and carry numerous patient care and/or life support devices in a self contained, mobile intensive care bed unit. Therefore, it is an object of the present invention to provide a novel, mobile bed structure having a self-contained construction including means to hold and carry numerous patient care and/or life support devices.

In a preferred form of the invention the bed structure has support means located underneath the bed structure supporting the patient. Therefore it is another object to provide a bed structure of the above noted type having support means for supporting and carrying the referenced devices underneath the patient support structure.

The bed structure, having the features previously described, is provided with built in electrical wiring and pneumatic lines and portable sources of electrical energy, oxygen, air pressure and the like which are supported on and can be transported with the bed structure.

Thus it is another object of the present invention to provide a mobile bed unit having built in electrical and pneumatic lines and sources of electrical energy, oxygen, air pressure and the like such that it is a self contained, mobile intensive care unit.

In one form of the invention, the electrical and/or pneumatic lines are carried in conduits constructed of non-conductive plastic materials to thereby inhibit the likelihood of exposing the patient to unwanted electrical voltage. Therefore it is another object of the present invention to provide a unit of the above described type in which the electrical and/or pneumatic lines are electrically insulated from the bed structure and in this regard are carried in electrically non-conductive conduits.

Other objects, features, and advantages of the present invention will become apparent from the subsequent description and the appended claims, taken in conjunction with the accompanying drawings, in which:

FIG. 1 is a pictorial view of the bed structure with various devices located thereon for monitoring and providing treatment to the patient;

FIG. 2 is a fragmentary pictorial view, to enlarged scale, of a portion of a tunnel and support structure shown disassembled from the main frame of the bed structure;

Figure 3:
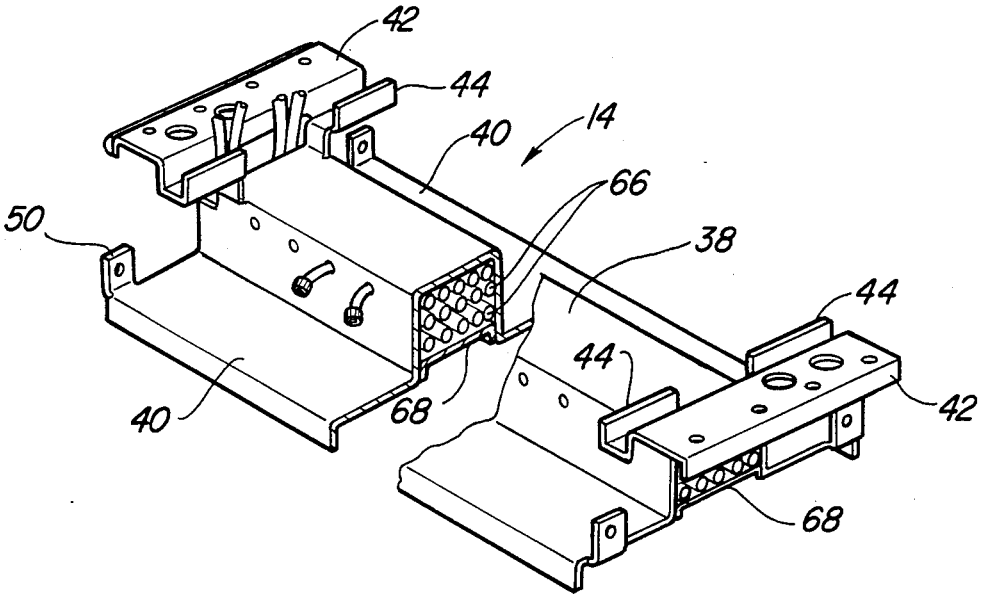
FIG. 3 is a pictorial view with some parts broken away of the tunnel and support structure of FIGS. 1 and 2.
Figure 4:
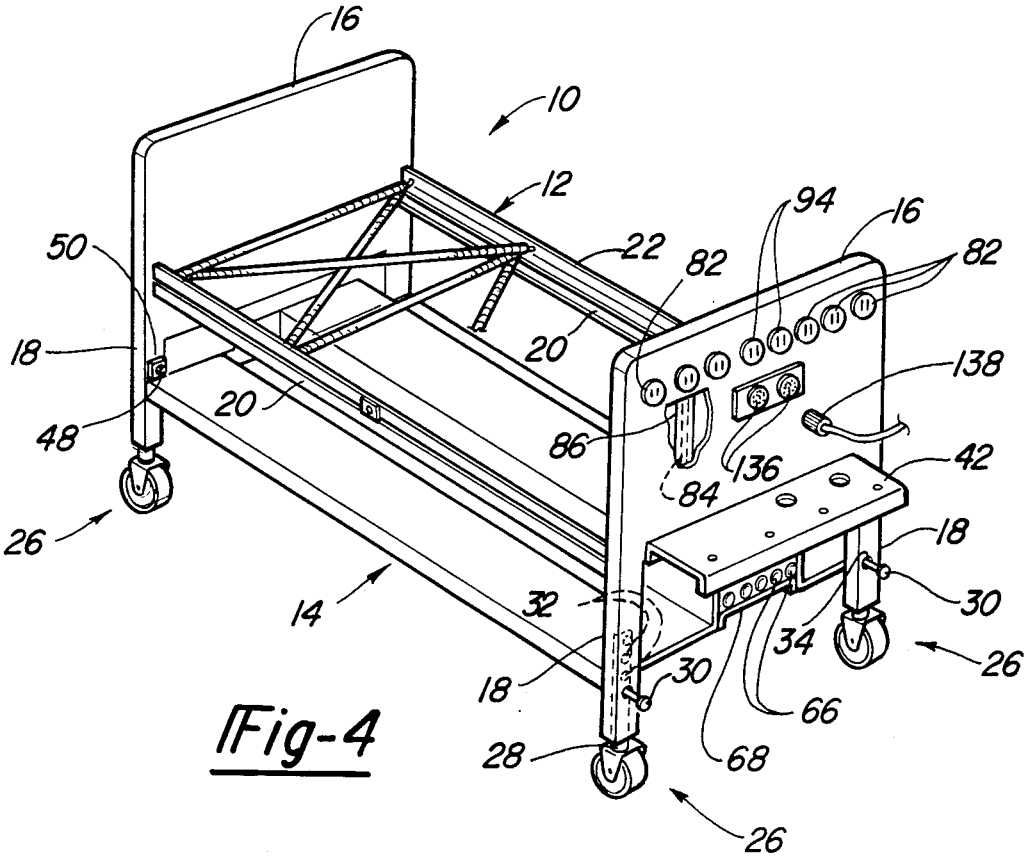
FIG. 4 is a pictorial view of the bed structure of FIG. 1 with the various devices removed and with some portions shown in section and others broken away.

Looking now to the drawings, a bed structure 10 is shown and includes a main frame 12 and a tunnel and support structure 14. The main frame 12 includes a pair of similarly constructed end members 16 each having a pair of depending leg portions 18. The end members 16 are held together by longitudinally extending bars 20 which are adapted to hold a patient support structure 22 which in turn supports a mattress 24. The support structure 22 is only partially, diagrammatically shown and can be of any suitable construction such as those which can be articulated to various positions to facilitate patient treatment and/or comfort. Since the details of such structures are known to those skilled in the art and do not constitute a part of the present invention, such details have been omitted for simplicity.

The height of the main frame 12 from the floor and hence the height of the patient located on the support structure 22 and mattress 24 can be selectively adjusted by manipulation of wheel assemblies 26 located at each of the leg portions 18. The wheel assemblies 26 include support rods 28 which are extendable more or less into the hollow ends of leg portions 18 with the height being simply set by pins, such as pins 30 in leg portions 18, engageable with one of a plurality of through bores 32 arranged along the support rods 28 and engageable with an aligned bore 34 on the leg portions 18. Guard rails 36 can be movably located at opposite sides of the main frame 12 and can be selectively adjustable, in a manner well known in the art, to secure the patient on the bed structure 10.

The bed structure 10 is additionally held together by the longitudinally extending tunnel and support structure 14. The tunnel and support structure 14 is generally of a hat shaped construction having a central hat portion 38 and a pair of side shelf portions 40 extending generally co-extensively with and transversely from opposite sides of hat portion 38. A pair of end support plate portions 42 are located at opposite longitudinal ends of the tunnel and support structure 14. Transverse channel portions 44 are adapted to receive the bottom edges 46 of end members 16 located between the leg portions 18 (see FIG. 2). Fasteners such as threaded screws 48 through channel portions 44 and into bottom edges 46 secure the tunnel and support structure 14 to the main frame 12. Similarly fasteners 49 extending through flanges 50 at the ends of shelf portions 40 and into leg portions 18 to further secure the tunnel and support structure 14 to the main frame 12. Thus it can be seen that the tunnel and support structure when secured to the main frame 12 will add structural strength and rigidity to the overall bed structure 10. As will be seen the side shelf portions 40 are located beneath the patient support structure 22 and permit various devices for servicing the patient to be located there.

The central hat portion 39 is provided to receive electrical wiring harnesses, electrical communication lines, and fluid lines such as pneumatic and hydraulic lines and the like, as an integral part of the bed structure to facilitate input and output access to the various devices to be carried with the bed structure. Thus the hat portion 38 will include an alternating current or a-c line 52, a direct current or d-c line 54, electrical communication lines 56, a pneumatic oxygen line 58, a vacuum or suction line 60, a pneumatic air pressure line 62 and a hydraulic line 63. The above noted lines are carried in longitudinally extending conduits 66 which are securely held in the hat portion 38 by a longitudinal cover plate 68. While, in most cases, only one of each line is shown it is understood that multiple lines of each type could be employed and to this end spare conduits 66 are provided.

In a hospital environment it is desirable to utilize diagnostic, patient support and treatment devices which are operative from low voltages and preferably low d-c (direct current) voltages. Frequently these hospital devices are designed to operate on low d-c voltages either directly or in conjunction with a-c to d-c converters operable from a source of a-c (alternating current) such as a 110 volt a-c wall plug outlet. Thus it is a common practice to utilize stands separate from the bed to support these devices with the low d-c power being obtained internally from the device which is connected to a 110 volt a-c source from a wall plug or from a separate or portable a-c to d-c converter, i.e. which operates from a conventional a-c source at conventional outlets to provide the low d-c voltage.

Thus, in the present invention, an a-c to d-c converter 70 is provided and is adapted to be located on one of the end support plate portions 42, (see FIG. 1). The converter 70 is operable from a conventional a-c source, i.e. 110 volt a-c wall plug, via the a-c electrical line 52 and provides the low d-c voltage output at d-c line 54. Alternatively, the converter 70, can be energized directly by an electrical cord from the a-c wall plug. In addition a d-c power pack 72 is provided and includes a built in battery 74 and trickle charger 76; power pack 72 is connected to the a-c source via electrical line 52 such that the proper charge can be maintained on the battery 74. In the event of a loss of power from the a-c source or in the event that the bed structure 10 is being moved in an emergency situation, the battery 74 will provide the required d-c power to maintain the associated electrical system operative. Again in a stationary mode for bed structure 10, the power pack 72 could be energized directly from an a-c wall plug. A meter 78, with an appropriate switch 80, can provide an indication of the magnitude of a-c voltage input, the d-c voltage output with an a-c voltage input and the d-c voltage output by the battery 74 without an a-c voltage input. The structures of a-c to d-c converters are well known in the art and are exemplified by devices such as Model PR-15 or RR-30 sold under the name Tripplite. Likewise d-c power packs are well known in the art and are exemplified by devices such as Stock No. 0217-3813-910 manufactured by Ohio Medical Products. It should be noted that some devices have built in portable, d-c power supplies to permit functioning of such devices in the event of loss of power. The central d-c power supply of the present invention, of coures, provides power not only to these devices but others that lack such portable supplies.

A plurality of d-c outlets 82 are provided at opposite transverse sides of end members 16. The d-c outlets 82, are connected to d-c line 54 via electrical conductors 84 located within the end members 16. The d-c conductors are supported in conduits 86 located in the end members 16. Of course, the d-c line 54 is connected to the d-c output of the a-c to d-c converter 70 and, alternatively, to the d-c output from the d-c power pack 72 via a switch 88. Thus support and monitoring devices requiring d-c power can be conveniently powered from each corner of the bed structure 10. In addition a number of d-c outlets 89 can be appropriately provided at various locations on the side shelf portions 40. While the higher voltage a-c is preferably isolated from the bed structure 10, the a-c line 52, via a number of outlets such as 90, provides availability and easy access to such a-c power. Each of the a-c outlets 90 is electrically insulated from its surrounding support structure. It should be noted that while the a-c line 52 is provided it need not be energized or alternatively could be used to carry a d-c voltage or an a-c voltage of a low amplitude, i.e. substantially less than 110 v. a-c (preferably no greater than 24 v. a-c) and no greater than around 24 v. d-c. Similarly all of the electrical and pneumatic lines are electrically insulated from the main frame 12 since support conduits 66 and 86 are, in one form of the invention, constructed of an electrically non-conductive plastic material such as PVC i.e. polyvinylchloride. Alternatively, the tunnel and support structure 14 can be electrically insulated from the main frame 12. With regard to the latter the tunnel and support structure 14 in another form can be made of a similar, electrically non-conductive plastic material as could the members 16. With the use of conduits 66 and 86 to support and insulate the various electrical and fluid lines noted, in one form of the invention, the conduits such as 66 and 86 for the communication lines 56 could be shielded and grounded to inhibit r-f and other types of stray signals from interfering with the signals being carried by lines 56.

In order to provide means for monitoring various devices providing indications of patient condition i.e. pulse, blook pressure, etc. and to permit easy access to monitoring equipment, a plurality of electrical communication lines 56 are provided in the tunnel and support structure 14 and are connected to numerous outlets such as outlets 92 on side shelf portions 44 and outlets 94 at end members 16 and at each end of the bed structure 10. The communication lines 56 are supported in conduits 86 in end members 16.

In the present invention, in order that the structure be self contained, supports for the devices are provided as an integral part of the bed structure 10. Thus hollow support tubes 96 are located at each corner of end members 16. An example of use of one of the support tubes 96 is illustrated in FIG. 1 where a T-rod 98 is supported therein and holds a fluid sack 100 fo material for intravenous injection to a patient; the amount of fluid injected is controlled by an infusion controlling device 102 which is clamped directly to the associated one of the supports 96. Again in a preferred form, the support tubes 96 are constructed of a similar electrically non-conductive plastic material (i.e. PVC) to promote electrical insulation from the patient. The infusion controlling device 102 can be of a type known in the art such as EPIC 100 manufactured by American McGaw, or a Model 350 manufactured by Imed Corporation. Another example is the Model 530 infusion pump manufactured by Ivac Corporation. A visual monitor 104 is similarly supported on one of the other supports 96 to provide easy visual observation of patient characteristics e.g. vital signs such as pulse, blook pressure, electro cardiogram, etc. Again these monitoring devices are well known in the art and, for example, can be one of the Siemens System 400 type manufactured by Siemens Corporation. Another example is a Theracard 400 defibrillator-monitor also manufactured by Siemens Corportion. Note that by providing multiple supports 96 at both ends of the bed structure 10 easy access to the devices and the patient is afforded. The noted devices can be operative from one of the d-c outlets 82 as in the portable mode or alternatively, in a fixed mode, can be powered by a-c via a-c outlets 90 or direct connections to a wall plug carrying a-c voltage via a-c cords 105 and 107.

A supply of oxygen under pressure in an oxygen tank 106 is held on one of the end support plate portions 42 and can be connected to the oxygen line 58. Similarly an air supply under pressure in an air tank 108 is held on the same end support plate portion 42 and can be connected to the air pressure line 62. The oxygen line 58 and air pressure line 62 are connected to a control unit 110 supported on one of the side shelf portions 40. The control unit 110 has outlets 112 and 114 by which the supply of oxygen and air can be conveniently accessed. The control unit 110 has meters 113 and 115 providing a read out of the magnitude of outlet pressure for both the oxygen and the air, respectively. In the portable mode the oxygen tank 106 and air tank 108 will be connected to the oxygen and air lines 58 and 62, respectively; in the alternate fixed mode the oxygen line 58 and air line 62 will be connected to supplies of oxygen and air at fixed wall receptacles located in the hospital room.

An electrically operated suction or vacuum pump 116 is supported on the side shelf portion 40 and is connected to the d-c electrical line 54 via one of the d-c outlets 89 and can be connected to suction line 60 at its outlet 117 to provide a predetermined magnitude of vacuum. The suction line 60 is connected to the control unit 110 to provide suction or vacuum at outlet 118. Thus the outlet 118 at the control unit 110 permits access to the vacuum pump 117 with another meter 120 providing an indication of the magnitude of vacuum. While only the control unit 110 and pump 116 are shown on the side shelf portion 40, it should be understood that other apparatus could be similarly supported. Again, in the fixed or immobile mode of the bed structure 10 the suction line 60 can be connected to a fixed source of vacuum at a wall receptacle located in the hospital room.

One of the difficulties in patient care is providing a means of periodically determining the weight of the patient. A simple weighing structure is shown in conjunction with the bed structure 10.

Thus a first, fixed support 124 is mounted to one of the end members 16 and has a pair of hooks 126 at its upper end located well above the surface of the mattress 24. A second, movable support 127 is mounted to the opposite one of the end members 16 and has a pair of hooks 128 also at its upper end located well above the surface of the mattress 24. A sling 130 can be supported at its opposite ends by the hooks 126 and 128 via transducers 131 and 132, respectively. The hooks 128 can be moved upwardly or downwardly by a gear drive 133 via a crank 135. The patient can now be easily placed onto the sling 130 and elevated from the surface of the mattress 24. Transducers 131 and 132 are connected to a meter 134 via electrical communication outlets 94 and selected ones of electrical communication lines 56 and will provide an indication of the patient's weight. Power for the meter 134 can be secured from one of the d-c outlets 82 at the associated one of the end members 16. The transducers 131 and 132 and meter 134 can be of a type known in the art, examples of which are Model 2001 manufactured by Scale-Tronix or Weighmobile manufactured by Dittmar and Perin Co.

Note that the height of the main frame 12 and hence of the patient can be easily adjusted via selective movement of the wheel assemblies 26 and support rods 28 up or down within the hollow leg portions 18. Since the main frame 12 and the tunnel and support structure 14 with its side shelf portions 40 and end support plate portions 42 are fixed together, they move together with the devices supported thereby. Thus, all of the electrical, pneumatic, intravenous, etc. connections to the patient or the the supported apparatus servicing the patient will be moved in unison with the patient and associated apparatus; hence cords, lines, etc. will not be subject to unnecessary strain or undue disturbance.

Thus the bed structure 10 has two distinct modes of operation. In the fixed or immobile mode the bed structure 10 can be powered solely by low voltage d-c via the a-c to d-c converter 70. Note that the converter 70 can be connected directly to an a-c wall plug and hence in this d-c mode of operation no other a-c voltage would be present at the bed structure 10. In this same fixed mode the numerous devices such as infusion control devices 102, monitor device 104, the weight scale and transducers 131, 132, etc. can be alternatively powered by a-c voltage via outlets 90 or by direct connection to a wall plug.

In the event the patient has to be moved quickly, as in an emergency situation, the bed structure 10 can be placed in its mobile or portable mode via the power from battery 74 and hence the patient can remain in the unit with all of the life support equipment and monitoring devices in operation and be treated and/or transported to the emergency facility as required.

It is desirable to be able to monitor the patient's condition at a remote, central station. In this regard the input and/or output signals from the numerous devices such as infusion device 102, monitor device 104, transducers 131, 132, etc. can be connected to an access plug 136 via communication outlets 94 and associated electrical communication lines 56. Now in the fixed or immobile mode, the multiple pronged access plug 136 can be connected to a suitable mating plug 138 and the patient and equipment information can be transmitted to and made available for display and/or other monitoring means at the remote central station.

Thus it can be seen that the present invention provides a self-contained intensive care unit which is adapted to have a fixed mode of operation as noted and to have a portable mode of operation facilitating patient transport and care in emergency situations with the least amount of disruption of the systems monitoring and/or treating the patient. Note that even in the fixed or immobile mode the bed structure 10 provides an efficient and effective means of locating and supporting the various operative devices such as to permit an uncluttered and direct access to the patient. At the same time the electrical and pneumatic lines are all carried by and are substantially totally shielded in electrically nonconductive conduits whereby the structural portions of the bed structure 10 are essentially insulated from electrical voltages and currents. The latter insulation, of course, is in addition to the conventional electrical insulation on a-c and d-c lines.

While it will be apparent that the preferred embodiments of the invention disclosed are well calculated to fulfill the objects above stated, it will be appreciated that the invention is susceptible to modification, variation and change without departing from the proper scope of fair meaning of the invention.

What is claimed is:

1. A self contained, mobile intensive care bed structure adapted to carry a plurality of devices for monitoring and/or providing treatment to a patient in the bed structure, comprising:

a main frame structure including opposite end members and a patient support structure, a tunnel structure extending generally longitudinally between opposite end members, said tunnel structure carry a direct current line, an alternating current line, a communication line, a pneumatic oxygen line, a pneumatic air line, and a pneumatic vacuum line, support means comprising:

(a) longitudinally extending shelves located at opposite transverse sides of said main frame structure and adapted to support and carry one or more of said devices, (b) support plates extending outwardly from each of said end members and adapted to support and carry one or more of said devices, and (c) support tubes at each of said end members and adapted to support and carry one or more of said devices, direct current power means supported by said support means and comprising:

(a) a-c to d-c converter means carried by said support means and having a stationary mode being operable from a source of alternating current separate from said bed structure and being slectively operable in said stationary mode to provide a low voltage direct current output to said direct current line, and (b) direct current source means having a mobile mode and being selectively operable in said mobile mode for providing the low voltage direct current output to said direct current line independently of the source of alternating current, an oxygen tank supported on said support means, oxygen outlet means supported on said support means and operable with said pneumatic oxygen line for providing oxygen from said oxygen tank at a location remote from said oxygen tank, said oxygen outlet means operable in a stationary mode with said pneumatic oxygen line for providing oxygen from a source independent from said oxygen tank and remote from said bed structure, an air tank supported on said support means, air outlet means supported on said support means and operable with said pneumatic air line for providing air under pressure from said air tank at a location remote from said air tank, said air outlet means operable in a stationary mode with said pneumatic air outlet line for providing air from a source independent from said air tank and remote from said bed structure, a vacuum pump supported on said support means, suction outlet means supported on said support means and operable in a mobile mode with said pneumatic vacuum line for providing vacuum from said vacuum pump at a location remote from said vacuum pump, said suction outlet means operable in a stationary mode with said pneumatic vacuum line for providing vacuum from a source independent from said vacuum pump and remote from said bed structure, direct current electrical outlet means connected to said direct current line and located at a plurality of positions on said main frame for providing d-c power for at least some of said devices, alternating current electrical outlet means connected to said alternating current line and located at a plurality of positions on said main frame for providing a-c power for at least some of said devices, communication outlet means connected to said communication line and located at a plurality of positions on said main frame for providing connection to at least some of said devices for transmitting various signals to and/or from such devices, monitor access means connected to said communication line for providing access to said various signals from the devices whereby said various signals can be communicated to a monitoring station remote from said bed structure, height adjustment means selectively operable for adjusting the height of said main frame and hence of the patient with said support means and the devices supported thereon moving with said main frame whereby connecting lines from various ones of the devices to the patient will be generally undisturbed as the height of said main frame and hence of the patient is adjusted, and wheel means supporting said main frame while permitting transport of said bed structure from one location to another.

2. The bed structure of claim 1 with said direct current line, alternating current line, communication line, oxygen line, air line and vacuum line all being supported on insulation means for electrically insulating each of said lines from said main frame structure.

3. The bed structure of claim 2 with said insulation means comprising a plurality of conduits constructed of an electrically non-conductive material.

4. The bed structure of claim 1 with said direct current electrical outlet means located at least at one of said end members.

5. The bed structure of claim 1 with said communication outlet means located at least at one of said end members.

6. The bed structure of claim 1 further comprising a hydraulic line carried in said tunnel structure.

7. The bed structure of claim 1 further comprising a hydraulic line carried in said tunnel structure and with said insulation means insulating said hydraulic line from the others of said lines.

8. A self contained, mobile instensive care bed structure adapted to carry a plurality of devices for monitoring and/or providing treatment to a patient in the bed structure, comprising:

a main frame structure including opposite end members and a patient support structure, a housing structure extending generally longitudinally between opposite end members, said housing structure carrying an electrical current line, support means on said main frame structure and adapted to support and carry one or more of said devices, electrical current source means supported on said support means and having a fixed mode and a mobile mode and being selectively operable in said fixed mode for providing an electrical current output to said electrical current line from a fixed current source independent of said bed structure and being selectively operable in said mobile mode for providing an electrical surrent output to said electrical current line independently of the fixed current source, electrical current outlet means connected to said electrical current line and located at a plurality of position on said main frame for providing electrical power for at least some of said devices, and wheel means supporting said main frame while permitting transport of said bed structure from one location to another, said electrical current line being a direct current line and with said electrical current outlet means being a direct current electrical outlet means connected to said direct current line, a communication line carried in said housing structure, communication outlet means connected to said communication line and located at a plurality of positions on said main frame structure for providing connections to at least some of said devices for transmitting various signals to and/or from such devices.

9. The bed structure of claim 8 further comprising:

monitor access means connected to said communication line for providing access to said various signals from the devices whereby said various signals can be communicated to a monitoring station remote from said bed structure.

10. The bed structure of claim 8 further comprising:

a pneumatic oxygen line carried in said housing structure, an oxygen tank supported on said support means, oxygen outlet means supported on said support means and operable with said pneumatic oxygen line for providing oxygen from said oxygen tank at a location remote from said oxygen tank, said oxygen outlet means operable in a stationary mode with said pneumatic oxygen line for providing oxygen from a source independent from said oxygen tank and remote from said bed structure.

11. The bed structure of claim 8 further comprising:

height adjustment means selectively operable for adjusting the height of said main frame and hence of the patient with said support means and the devices supported thereon moving with said main frame whereby connecting lines from various ones of the devices to the patient will be generally undisturbed as the height of said main frame and hence of the patient is adjusted.

12. A self contained, mobile intensive care bed structure adapted to carry a plurality of devices for monitoring and/or providing treatment to a patient in the bed structure, comprising:

a main frame structure including opposite end members and a patient support structure, a housing structure extending generally longitudinally between opposite end members, said housing structure carrying an electrical current line, support means on said main frame structure and adapted to support and carry one or more of said devices, electrical current source means supported on said support means and having a fixed mode and a mobile mode and being selectively operable in said fixed mode for providing an electrical current output to said electrical current line from a fixed current source independent of said bed structure and being selectively operable in said mobile mode for providing an electrical current output to said electrical current line independently of the fixed current source, electrical current outlet means connected to said electrical current line and located at a plurality of positions on said main frame for providing electrical power for at least some of said devices, and wheel means supporting said main frame while permitting transport of said bed structure form one location to another, said electrical current line being a direct current line and with said electrical current outlet means being a direct current electrical outlet means connected to said direct current line, insulation means extending substantially co-extensively with said direct current line for electrically insulating said direct current line from said main frame structure, a communication line carried in said housing structure, communication outlet means connected to said communication line and located at a plurality of positions on said main frame structure for providing connections to at least some of said devices for transmitting various signals to and/or from such devices and with said insulating means extending substantially co-extensively with said communication line for electrically insulating said communication line from said main frame structure.

13. A self contained, mobile intensive care bed structure adapted to carry a plurality of devices for monitoring and/or providing treatment to a patient in the bed structure, comprising:

a main frame structure including opposite end members and a patient support structure, a housing structure extending generally longitudinally between opposite end members, said housing structure carrying an electrical current line, support means on said main frame structure and adapted to support and carry one or more of said devices, electrical current source means supported on said support means and having a fixed mode and a mobile mode and being selectively operable in said fixed mode for providing an electrical current output to said electrical current line from a fixed current source independent of said bed structure and being selectively operable in said mobile mode for providing an electrical current output to said electrical current line independently of the fixed current source, electrical current outlet means connected to said electrical current line and located at a plurality of positions on said main frame for providing electrical power for at least some of said devices, and wheel means supporting said main frame while permitting transport of said bed structure from one location to another, said electrical current line being a direct current line and with said electrical current outlet means being a direct current electrical outlet means connected to said direct current line, a pneumatic vacuum line carried in said housing structure, a vacuum pump supported on said support means, suction outlet means supported on said support means and operable in a mobile mode with said pneumatic vacuum line for providing vacuum from said vacuum pump at a location remote from said vaccum pump, said suction outlet means operable in a stationary mode with said pneumatic vacuum line for providing vacuum from a source independent from said vacuum pump and remote from said bed structure.

14. A self contained, mobile intensive care bed structure adapted to carry a plurality of devies for monitoring and/or providing treatment to a patient in the bed structure, comprising:

a main frame structure including opposite end members and a patient support structure, a housing structure extending generally longitudinally between opposite end members, said housing structure carrying an electrical current line, support means on said main frame structure and adapted to support and carry one or more of said devices, electrical current source means supported on said support means and having a fixed mode and a mobile mode and being selectively operable in said fixed mode for providing an electrical current output to said electrical current line from a fixed current source independent of said bed structure and being selectively operable in said mobile mode for providing an electrical current output to said electrical current line independently of the fixed current source, electrical current outlet means connected to said electrical current line and located at a plurality of positions on said main frame for providing electrical power for at least some of said devices, and wheel means supporting said main frame while permitting transport of said bed structure from one location to another, said electrical current line being a direct current line and with said electrical current outlet means being a direct current electrical outlet means connected to said direct current line, a pneumatic oxygen lien carried in said housing structure, an oxygen tank supported on said support means, oxygen outlet means supported on said support means and operable with said pneumatic oxygen line for providing oxygen from said oxygen tank at a location remote from said oxygen tank, said oxygen outlet means operable in a stationary mode with said pneumatic oxygen line for providing oxygen from a source independent from said oxygen tank and remote from said bed structure, a pneumatic vacuum line carried in said housing structure, a vacuum pump supported on said support means, suction outlet means supported on said support means and operable in a mobile mode with said pneumatic vacuum line for providing vacuum from said vacuum pump at a location remote from said vacuum pump, said suction outlet means operable in a stationary mode with said pneumatic vacuum line for providing vacuum from a source independent from said vacuum pump and remote from said bed structure.

15. A self contained, mobile intensive care bed structure adapted to carry a plurality of devies for monitoring and/or providing treatment to a patient in the bed structure, comprising:

a main frame structure including opposite end members and a patient support structure, a housing structure extending generally longitudinally between opposite end members, said housing structure carrying an electrical current line, support means on said main frame structure and adapted to support and carry one or more of said devices, electrical current source means supported on said support means and having a fixed mode and a mobile mode and being selectively operable in said fixed mode for providing an electrical current output to said electrical current line from a fixed current source independent of said bed structure and being selectively operable in said mobile mode for providing an electrical current output to said electrical current line independently of the fixed current source, electrical current outlet means connected to said electrical current line and located at a plurality of positions on said main frame for providing electrical power for at least some of said deviced, and wheel means supporting said main frame while permitting transport of said bed structure from one location to another, said electrical current line being a direct current line and with said electrical current outlet means being a direct current electrical outlet means connected to said direct current line, a pneumatic oxygen line carried in said housing structure, an oxygen tank supported on said support means, oxygen outlet means supported on said support means and operable with said pneumatic oxygen line for providing oxygen from said oxygen tank at a location remote from said oxygen tank, said oxygen outlet means operable in a stationary mode with said pneumatic oxygen line for providing oxygen from a source independent from said oxygen tank and remote from said bed structure a pneumatic air line carried in said housing structure, an air tank supported on said support means, air outlet means supported on said support means and operable with said pneumatic air line for providing air under pressure from said air tank at a location remote from said air tank, said air outlet means operable in a stationary mode with said pneumatic air outlet line for providing air from a source independent from said air tank and remote from said bed structure, a pneumatic vacuum line carried in said housing structure, a vacuum pump supported on said support means, suction outlet means supported on said support means and operable in a mobile mode with said pneumatic vacuum line for providing vacuum from said vacuum pump at a location remote from said vacuum pump, said suction outlet means operable in a stationary mode with said pneumatic vacuum line from providing vacuum from a source independent from said vacuum pump and remote from said bed structure.

16. A self contained, mobile intensive care bed structure adapted to carry a plurality of devices for montioring and/or providing treatment to a patient in the bed structure, comprising:

a main frame structure including opposite end members and a patient support structure, a housing structure extending generally longitudinally between opposite end members, said housing structure carrying a plurality of electrical lines, support means adapted to support and carry one or more of said devices, electrical power means:

(a) including first means carried by said support means and having a stationary mode being operable from a source of electrical energy separate from said bed structure and being substantially operable in said stationary mode to provide electrical power to at least some of said electrical lines, and (b) further including second means having a mobile mode and being selectively operable in said mobile mode for providing electrical power to at least some of said electrical lines, electrical outlet means connected to said some of said electrical lines and located at a plurality of positions on said main frame fro providing electrical power for at least some of said devices, a communication line carried in said housing structure, communication outlet means connected to said communication line and located at a plurality of positions on said main frame structure for providing connections to at least some of said devices for transmitting various signals to and/or from such devices, first conduit means extending substantially co-extensivley with said electrical lines for electrically insulating said electrical lines from said main frame structure, and second conduit means extending substantially co-extensively with said communication line for shielding said communication line from stray electrical signals.

17. The bed structure of claim 16 further comprising:

height adjustment means selectively operable for adjusting the height of said main frame and hence of the patient with said support means and the devices supported thereon moving with said main frame whereby connecting lines from various ones of the devices to the patient will be generally undisturbed as the height of said main frame and hence of the patient is adjusted.

18. The bed structure of claim 16 with said support means comprising:

(a) longitudinally extending shelves located at opposite transverse sides of said main frame structure and adapted to support and carry one or more of said devices, (b) support plates extending outwardly from each of said end members and adapted to support and carry one or more of said devices, and (c) support tubes at each of said end members and adapted to support and carry one or more of said devices, height adjustment means selectively operable for adjusting the height of said main frame and hence of the patient with said support means and the devices supported thereon moving with said main frame whereby connecting lines from various ones of the devices to the patient will be generally undisturbed as the height of said main frame and hence of the patient is adjusted.

19. The bed structure of claim 16 with said housing structure being generally a tunnel structure extending generally longitudinally between said opposite end members.

20. The bed structure of claim 16 with said electrical power means comprising a source of direct current.

21. A self contained, mobile intensive care bed structure adapted to carry a plurality of devices for monitoring and/or providing treatment to a patient in the bed structure, comprising:

a main frame structure including opposite end members and a patient support structure, patient support means for supporting a patient, device support means comprising a longitudianlly extending shelf located beneath said patient support means on one transverse side of said main frame structure and having a support surface adapted to support and carry one or more of said devices, said support surface extending in a plane located proximate to the lower ends of said opposite end members, height adjustment means selectively operable for adjusting the height of said main frame and of said patient support means and hence of the patient and for simultaneously adjusting the height of said shelf and the devices supported thereon such that adjustment of the height of said main frame a preselected distance will result in adjustment of the height of the patient and said shelf the same said preselected distance whereby connecting lines from various ones of the devices to the patient will be generally undisturbed as the height of said main frame and hence of the patient is adjusted, and wheel means supporting said main frame while permitting transport of said bed structure from one location to another.

22. The bed structure of claim 21 further comprising weighing means for weighing the patient, said weighing means comprising a sling structure and sling support means located at opposite ends of said main frame structure and connected to said opposite end members for supporting said sling structure, transducer means operatively connected with said sling support means for providing an indication of the weigth of the patient.

23. A self contained, mobile intensive care bed structure adapted to carry a plurality of devices for monitoring and/or providing treatment to a patient in the bed structure, comprising:

a main frame structure including opposite end members and a patient support structure, a housing structure extending generally longitudinally between opposite end members, said housing structure carrying a plurality of electrical lines, support means adpated to support and carry one or more of said devices, electrical power means:

(a) including first means carried by said support means and having a stationary mode being operable from a source of electrical energy separate from said bed structure and being substantially operable in said stationary mode to provide electrical power to at least some of said electrical lines, and (b) further including second means having a mobile mode and being selectively operable in said mobile mode for providing electrical power to at least some of said electrical lines, electrical outlet means connected to said some of said electrical lines and located at a plurality of positions on said main frame for providing electrical power for at least some of said devices, a communication line carried in said housing structure, communication outlet means connected to said communication line and located at a plurality of positions on said main frame structure for providing connections to at least some of said devices for transmitting various signals to and/or from such devices, wheel means supporting said main frame while permitting transmport and said bed structure from one location to another.

24. the bed structure of claim 23 further comprising:

monitro access means connected to said communication line for providing access to said various signals from the devices whereby said various signal can be communciated to a monitoring station remote from said bed structure.

25. The bed structure of claim 23 further comprising weighing means for weighing the patient, said weighing means comprising a sling structure and sling support means located at opposite ends of said main frame structure and connected to said opposite end members for supporting said sling structure, transducer means operatively connected with said sling support means for providing an indication of the weight of the patient.

26. A self contained, mobile intensive care bed structure adapted to carry a plurality of devices for monitoring and/or providing treatment to a patient in the bed structure, comprising:

a main frame structure including opposite end members and a patient support structure, a tunnel structure extending generally longitudinally between opposite end members, said tunnel structure carrying on electrical current line, a communciation line, and a pneumatic line, support means comprising:

(a) shelves located at preselected sides of said main frame structure and adapted to support and carry one or more of said devices, (b) at least one support tube at one of said end members and adapted to support and carry one of said devices, electrical current power means supported by said support means having a mobile mode and being selectively operable in said mobile mode for providing a low voltage electrical current output to said electrical current line, electrical outlet means connected to said electrical current line and located at a plurality of positions on said main frame for providing electrical power for at least some of said devices, communciation outlet means connected to said communication line and located at a plurality of positions on said main frame for providing connection to at least some of said devices for transmitting various signals to and/or from such devices, and wheel means supporting said main frame while permitting transport of said bed structure from one location to another.

27. The bed structure of claim 26 further comprising:

monitor access means connected to said communication line for providing access to said various signals from the devices whereby said various signals can be communicated to a monitoring station remote from said bed structure.

28. The bed structure of claim 26 with said communication outlet means located at least at one of said end members.

29. A self contained, mobile intensive care bed structure adapted to carry a plurality of devices for monitoring and/or providing treatment to a patient in the bed structure, comprising:

a main frame structure including opposite end members and a patient support structure, hollow structure means for carrying an electrical current line and a communication line, support means located at preselected sides of said main frame structure and adapted to support and carry one or more of said devices, electrical current power means supported by said support means having a mobile mode and being selectively operable in said mobile mode for providing a low voltage electrical current output to said electrical current line, communication outlet means connected to said communciation line and located at a plurality of positions on said main frame for providing connection to at least some of said devices for transmitting various signals to and/or from such devices, wheel means supporting said main frame while permitting transport of said bed structure from one location to another.

30. The bed structure of claim 29 further comprising:

monitor access means connected to said communication line for providing access to said various signals from the devices whereby said various signals can be communicated to a monitoring station remote from said bed structure.

31. The bed structure of claim 29 with said communication outlet means located at least at one of said end members.

* * * * *

UNITED STATES PATENT AND TRADEMARK OFFICE

CERTIFICATE OF CORRECTION

PATENT NO. : 4,768,241

DATED : September 6, 1988

INVENTOR(S) : Daniel R. Beney

It is certified that error appears in the above-identified patent and that said Letters Patent is hereby corrected as shown below:

Col. 2, line 64, "39" should be --38--.
Col. 2, line 67, "integra" should be --integral--.
Col. 3, line 60, "coures" should be --course--.
Col. 4, line 37, "blook" should be --blood--.
Col. 4, line 51, "fo" should be --of--.
Col. 4, line 66, "blook" should be --blood--.
Col. 6, line 15, "the" first occurrence should be --to--.
Col. 6, line 27, "weight" should be --weigh--.
Col. 7, line 15, Claim 1, "carry" should be --carrying--.
Col. 7, line 36, Claim 1, "slectively" should be --selectively--.
Col. 9, line 5, Claim 8, "surrent" should be --current--.
Col. 9, line 10, Claim 8, "position" should be --positions--.
Col. 11, line 10, Claim 14, "devies" should be --devices--.
Col. 11, line 42, Claim 14, "lien" should be --line--.
Col. 11, line 66, Claim 15, "devies" should be --devices--.
Col. 12, line 22, Claim 15, "deviced" should be --devices--.
Col. 13, line 21, Claim 16, "fro" should be --for--.
Col. 14, line 12, Claim 21, "longitudianlly" should be --longitudinally--.
Col. 14, line 42, Claim 22, "weighth" should be --weight--.
Col. 15, line 9, Claim 23, "transmport" should be --transport--.
Col. 15, line 11, Claim 24, "the" should be --The--.
Col. 15, line 12, Claim 24, "monitro" should be --monitor--.

UNITED STATES PATENT AND TRADEMARK OFFICE

CERTIFICATE OF CORRECTION

PATENT NO. : 4,768,241

DATED : September 6, 1988

INVENTOR(S) : Daniel R. Beney

It is certified that error appears in the above-identified patent and that said Letters Patent is hereby corrected as shown below:

Col. 15, line 14, Claim 24, "signal" should be --signals--.
Col. 15, line 15, Claim 24, "communciated" should be --communicated--.
Col. 16, line 35, Claim 29, "munciation" should be --munication--.

Signed and Sealed this

Thirty-first Day of January, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,768,241

DATED : September 6, 1988

INVENTOR(S) : Daniel R. Beney

It is certified that error appears in the above-identified patent and that said Letters Patent is hereby corrected as shown below:

Col. 4, line 41, "44" should be --40--.
Col. 5, line 39, "117" should be --116--.
Col. 12, line 61, Claim 15, "from" should be --for--.
Col. 15, line 9, Claim 23, "and" should be --of--.
Col. 15, line 34, Claim 26, "on" should be --an--.
Col. 15, line 34, Claim 26, "communciation" should be --communication--.
Col. 16, line 1, Claim 26, "communciation" should be --communication--.

Signed and Sealed this

Fourteenth Day of March, 1989

*Attest:*

*Attesting Officer*

DONALD J. QUIGG

*Commissioner of Patents and Trademarks*